US010435647B2

(12) United States Patent
Norris

(10) Patent No.: US 10,435,647 B2
(45) Date of Patent: Oct. 8, 2019

(54) POLYESTERS MADE FROM BIO-RENEWABLE RAW MATERIALS FOR PREVENTING DYE REDEPOSITION ON FABRICS AND GARMENTS IN TEXTILE FINISHING AND GARMENT WASHING PROCESSES

(71) Applicant: The Seydel Companies, Inc., Pendergrass, GA (US)

(72) Inventor: Isaiah Norris, Braselton, GA (US)

(73) Assignee: The Seydel Companies, Inc., Pendergrass, GA (US)

( * ) Notice: Subject to any disclaimer, the term of this patent is extended or adjusted under 35 U.S.C. 154(b) by 0 days.

(21) Appl. No.: 16/001,707

(22) Filed: Jun. 6, 2018

(65) Prior Publication Data

US 2019/0048289 A1 Feb. 14, 2019

Related U.S. Application Data

(60) Provisional application No. 62/605,305, filed on Aug. 8, 2017.

(51) Int. Cl.

| | |
|---|---|
| ***C11D 3/00*** | (2006.01) |
| ***C11D 3/20*** | (2006.01) |
| ***C11D 11/00*** | (2006.01) |
| ***C11D 3/37*** | (2006.01) |

(52) U.S. Cl.

CPC ..... *C11D 3/0021* (2013.01); *C11D 3/201* (2013.01); *C11D 3/2044* (2013.01); *C11D 3/2065* (2013.01); *C11D 3/2082* (2013.01); *C11D 3/3715* (2013.01); *C11D 11/0017* (2013.01)

(58) Field of Classification Search

CPC ... C11D 3/0021; C11D 3/0036; C11D 3/3715; C11D 3/2086; C11D 3/2065; C11D 3/201; C11D 3/2013; C11D 3/0017; C11D 3/2082

See application file for complete search history.

(56) References Cited

U.S. PATENT DOCUMENTS

| | | | | |
|---|---|---|---|---|
| 6,916,775 | B1 * | 7/2005 | Gordon | C11D 3/0021 510/320 |
| 2003/0141489 | A1 * | 7/2003 | Yamada | C11D 1/40 252/582 |
| 2008/0028539 | A1 * | 2/2008 | Koch | C11D 3/0021 8/115.6 |
| 2009/0005286 | A1 * | 1/2009 | Detering | C08G 18/285 510/299 |

* cited by examiner

*Primary Examiner* — Eisa B Elhilo
(74) *Attorney, Agent, or Firm* — Georgiy L. Khayet

(57) ABSTRACT

A method for preventing a redeposition during washing of dyed fabric or garments made from natural and synthetic fibers is provided. The method may include admixing 0.1% to 1% of at least one anti-redeposition agent to an aqueous bath depending on the total weight of the dyed fabric to be washed. The anti-redeposition agent may include a water-soluble polyester made from bio-renewable raw materials. The water-soluble polyester may include a reaction product of a polyglycerol mixture, a sugar alcohol, a sebacic acid, and one of an unsaturated fatty acid, a saturated fatty acid, a fat or an oil, a polylactic acid, or polyhydroxyalkanoate.

18 Claims, 4 Drawing Sheets

POLYESTERS MADE FROM BIO-RENEWABLE RAW MATERIALS FOR PREVENTING DYE REDEPOSITION ON FABRICS AND GARMENTS IN TEXTILE FINISHING AND GARMENT WASHING PROCESSES

CROSS-REFERENCE TO RELATED APPLICATIONS

This patent application claims benefit of U.S. Provisional application No. 62/605,305 filed Aug. 8, 2017. The subject matter of the aforementioned application is incorporated herein by reference for all purposes.

TECHNICAL FIELD

This disclosure generally relates to methods for treatment of dyed fabrics. More particularly, this disclosure relates to polyesters made from bio-renewable raw materials preventing dye redeposition on fabrics and garments in textile finishing and garment washing processes.

DESCRIPTION OF RELATED ART

The approaches described in this section could be pursued but are not necessarily approaches that have been previously conceived or pursued. Therefore, unless otherwise indicated herein, the approaches described in this section are not prior art to the claims in this application and are not admitted to be prior art by inclusion in this section.

While washing a garment made of dyed fabric, the dye can be released from the dyed fabric and redeposit back on the same garment or another garment made from different fabric. The dye redeposition onto dyed fabric is a known problem in manufacturing processes of prewashing and stonewashing of the dyed fabrics. Stonewashing is a process of treating fabric to intentionally release dye from the fabric to non-uniformly fade the fabric. Stonewashing may also soften the fabric and make the fabric surface appear fuzzy and worn. Prewashing is a process of removing excess dye from the fabric uniformly in order to fade the fabric. Prewashing may also be used to soften the fabric by removing the sizing agent present in the fabric and to remove stiffening agent or in order to preshrink the fabric. The dye redeposition is also used for washing textile garments at home or in a commercial laundry. Due to the redeposition, the garment may change appearance or loose quality.

Anti-redeposition agents can be effective in preventing dye from redepositing on fabrics or during the washing process. Currently, synthetic petrochemical polymer products are widely used as anti-redeposition and anti-soling agents during textile and garment washing processes. Synthetic petrochemical polymer products are commonly washed away during the garment rinsing process and then drained in factory effluent streams. Recent studies of textile and garment laundering processes have shown that these synthetic petrochemical polymer products do not biodegrade in effluent filtering and treatment systems in factories or municipal treatment facilities. Therefore, the synthetic petrochemical polymer products become microparticles that pollute rivers, waterways, and oceans. Recent studies carried out by several institutes and organizations also proved that persistent residual petroleum polymer microparticles can be dangerous to many vegetable and animal life forms and have been discovered in bottled waters and beverages, fish and fowl, and legumes distributed for human consumption.

The pollution caused by the release of petroleum polymer microparticles during textile washing increases gradually. According to a recent report titled "A New Textiles Economy: Redesigning Fashion's Future" by Ellen Macarthur Foundation, the release of plastic microfibers into the ocean due to the washing of textiles could grow to 0.7 million tons per year by 2050. Therefore, there is a need for an environmentally-friendly products to be used as anti-redeposition agents in both industry textile washing and at home.

SUMMARY

This section is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

This disclosure relates to anti-redeposition agents for preventing dye redeposition onto dyed fabric made of natural or synthetic fibers during washing or textile finishing.

According to some embodiments of the disclosure, a method for preventing a dye redeposition onto dyed fabric during washing is provided. A method may include determining a weight of the dyed fabric and adding an anti-redeposition agent to an aqueous bath. A weight of the anti-redeposition agent can be between 0.1% and 1% of the weight of the dyed fabric. The anti-redeposition agent may include a water-soluble polyester made from bio-renewable raw materials. The water-soluble polyester may be a reaction product of at least one of a polyglycerol mixture, a sugar alcohol, a sebacic acid, and one of the following components: an unsaturated fatty acid, a saturated fatty acid, a fat or an oil, a polylactic acid, or polyhydroxyalkanoate.

The dyed fabric can be made from one or more natural fibers and synthetic fibers. The polyglycerol mixture may include mono-glycerol, di-glycerol, tri-glycerol, and tetra-glycerol. The sugar alcohol may include erythritol, threitol, arabitol, xylitol, ribitol, mannitol, sorbitol, galactitol, fucitol, or a mixture thereof.

In one embodiment of the disclosure, the water-soluble polyester is a reaction product of from 30% to 70% by weight of the polyglycerol mixture, from 0% to 20% by weight of the sugar alcohol, from 0% to 30% by weight of the unsaturated fatty acid, and from 15% to 25% by weight of the sebacic acid. The unsaturated fatty acid can be a myristoleic acid, a palmitoleic acid, a sapienic acid, an oleic acid, an elaidic acid, a vaccenic acid, a linoleic acid, a linoelaidic acid, an α-linolenic acid, or a mixture thereof.

In one embodiment of the disclosure, the water-soluble polyester is the reaction product of from 10% to 40% by weight of the polyglycerol mixture, from 10% to 20% by weight of the sugar alcohol, from 15% to 30% by weight of the saturated fatty acid, from 15% to 25% by weight of the sebacic acid, and from 1% to 10% of a tartaric acid. The saturated fatty acid can be caprylic acid, capric acid, lauric acid, myristic acid, palmitic acid, stearic acid, or a mixture thereof.

In one embodiment of the disclosure, the water-soluble polyester is the reaction product of from 10% to 40% by weight of the polyglycerol mixture, from 10% to 20% by weight of the sugar alcohol, from 15% to 30% by weight of one of the fat or the oil, and from 15% to 25% by weight of the sebacic acid. The fat can be a tallow derived from poultry or beef. The oil can include coconut oil, palm oil, cottonseed oil, soybean oil, olive oil, corn oil, canola oil, sunflower oil, or a mixture thereof.

In one embodiment of the disclosure, the water-soluble polyester can be the reaction product of from 10% to 40% by weight of the polyglycerol mixture, from 10% to 20% by weight of the sugar alcohol, from 15% to 30% by weight of the polylactic acid, and from 1% to 15% by weight the sebacic acid.

In one embodiment of the disclosure, the water-soluble polyester can be the reaction product of from 10% to 40% by weight of the polyglycerol mixture, from 10% to 20% by weight of the sugar alcohol, from 15% to 30% by weight of the polyhydroxyalkanoate, and from 1% to 15% by weight of the sebacic acid.

The water-soluble polyester can meet criteria of one or more industrial waste-water discharge regulations. The water-soluble polyester can be also used as a protecting agent for stretch fabrics during industrial washing. The water-soluble polyester can be also added as a sequestering agent and a soil-release agent to a laundry detergent during garment washing.

Additional objects, advantages, and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

Embodiments are illustrated by way of example and not limitation in the figures of the accompanying drawings, in which like references indicate similar elements and in which.

DETAILED DESCRIPTION OF EXAMPLE EMBODIMENTS

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

Generally, the embodiments of this disclosure are concerned with methods for preventing dye redeposition of dyed fabric during washing or textile finishing. Embodiments of the present disclosure may provide an anti-redeposition agent for preventing dye from resettling back onto the dyed fabric or other fabrics after the dye has been removed from the dyed fabric during washing.

According to embodiments of the present disclosure, the anti-redeposition agent may include a water-soluble polyester made of bio-renewable raw materials. The water-soluble polyester can be produced by a reaction a polyglycerol mixture, a sugar alcohol, a sebacic acid, and one of the following components: an unsaturated fatty acid, a saturated fatty acid, a fat or an oil, a polylactic acid, or polyhydroxyalkanoate.

The water-soluble polyesters disclosed herein can be used as anti-redeposition agents in industrial textile finishing processes, such as stonewashing and pre-washing of fabric. Because the water-soluble polyester disclosed herein are made from bio-renewable raw materials, it ca be biodegradable in effluent filtering and treatment systems and, therefore, satisfy current and anticipated effluent compatibility specifications and regulations.

The water-soluble biodegradable polyesters disclosed herein can be also used as additives in laundry detergents as sequestering agents for water softening and soil release agents. The water-soluble biodegradable polyesters disclosed herein can be also used as additives in laundry detergents for protection of stretch fabric (e.g. as spandex) in industrial washing.

Figure 1:
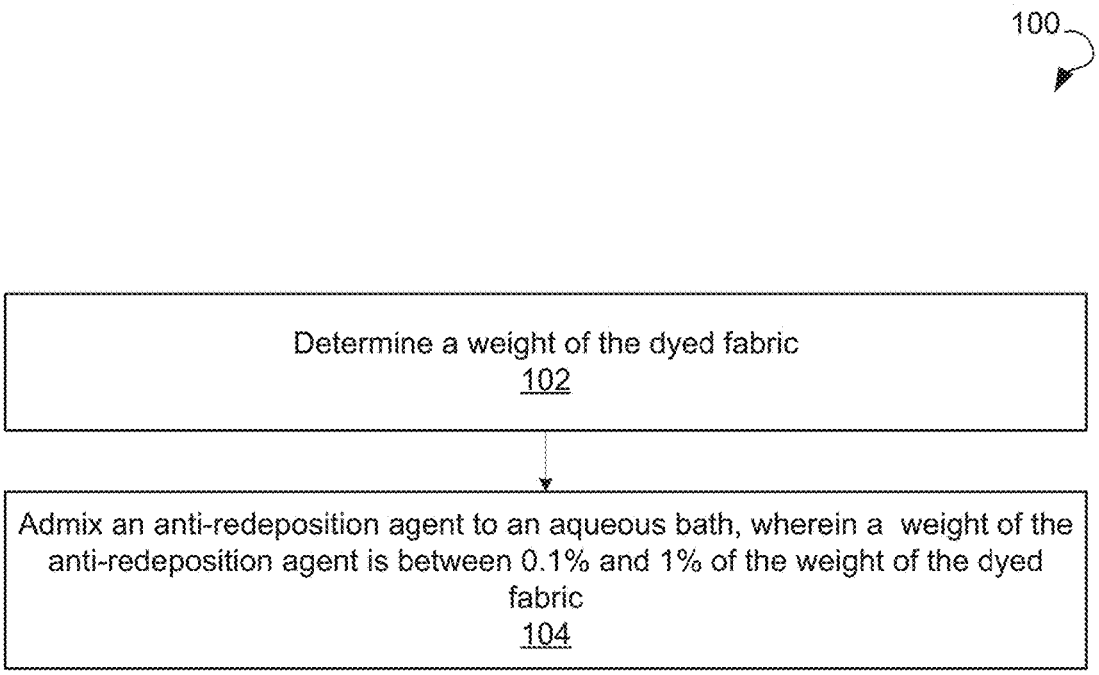
FIG. 1 is a flow chart of a method for preventing dye redeposition onto dyed fabric, according to some example embodiments.

FIG. 1 is flow chart showing a method 100 for preventing a dye redeposition in a dyed fabric during washing, according to some example embodiments. The method 100 can be used during washing of garments made of dyed fabric or textile finishing the dyed fabrics. The method 100 can be used for dyed fabrics made of naturals fibers, synthetic fibers and combination of natural fibers and synthetic fibers.

The method 100 may commence in block 102, with determining a weight of the dyed fabric. In block 104, the method may include adding an anti-redeposition agent to an aqueous bath. The aqueous bath may include a water, the dyed fabric, and the an anti-redeposition agent. The weight of the anti-redeposition agent can be from 0.1% to 1% of the weight of the dyed fabric.

The dyed fabric or garment can be further treated in the aqueous bath to release a portion of the dye from the dyed fabric into the aqueous bath. The dye is prevented from redepositing back onto the dyed fabric by maintaining the anti-redeposition agent in contact with the dyed fabric and the released portion of the dye. The treatment may include stonewashing or prewashing.

The anti-redeposition agent may include a water-soluble polyester made from bio-renewable raw materials. The water-soluble polyester can be produced by a reaction of a polyglycerol mixture, a sugar alcohol, a sebacic acid, and one of the following component: an unsaturated fatty acid, a saturated fatty acid, a fat or an oil, a polylactic acid, or polyhydroxyalkanoate. The polyglycerol mixture may include mono-glycerol, di-glycerol, tri-glycerol, and tetra-glycerol. The sugar alcohol may include erythritol, threitol, arabitol, xylitol, ribitol, mannitol, sorbitol, galactitol, fucitol, or a mixture thereof.

In one embodiment, the water-soluble polyester can be produced by a reaction of 30% to 70% by weight of the polyglycerol mixture, 0% to 20% by weight of the sugar alcohol, 0% to 30% by weight of the unsaturated fatty acid, and 15% to 25% by weight of the sebacic acid. The unsaturated fatty acid can be myristoleic acid, palmitoleic acid, sapienic acid, oleic acid, elaidic acid, vaccenic acid, linoleic acid, linoelaidic acid, α-linolenic acid, or a mixture thereof.

In another embodiment, the water-soluble polyester can be produced by a reaction of 10% to 40% by weight of the polyglycerol mixture, 10% to 20% by weight of the sugar alcohol, 15% to 30% by weight of the saturated fatty acid, 15% to 25% by weight of the sebacic acid, and 1% to 10% of a tartaric acid. The saturated fatty acid can be caprylic acid, capric acid, lauric acid, myristic acid, palmitic acid, stearic acid, or a mixture thereof.

In another embodiment, the water-soluble polyester can be produced by a reaction of 10% to 40% by weight of the polyglycerol mixture, 10% to 20% by weight of the sugar alcohol, 15% to 30% by weight of one of the fat or the oil, and 15% to 25% by weight of the sebacic acid. The fat can include a tallow derived from poultry or beef. The oil may include coconut oil, palm oil, cottonseed oil, soybean oil, olive oil, corn oil, canola oil, sunflower oil, or a mixture thereof.

In another embodiment, the water-soluble polyester can be produced by a reaction of 10% to 40% by weight of the polyglycerol mixture, 10% to 20% by weight of the sugar alcohol, 15% to 30% by weight of the polylactic acid, and 1% to 15% by weight of the sebacic acid.

In yet another embodiment, the water-soluble polyester can be produced by a reaction of 10% to 40% by weight of the polyglycerol mixture, 10% to 20% by weight of the sugar alcohol, 15% to 30% by weight of the polyhydroxyalkanoate, and 1% to 15% by weight of the sebacic acid.

Figure 2:
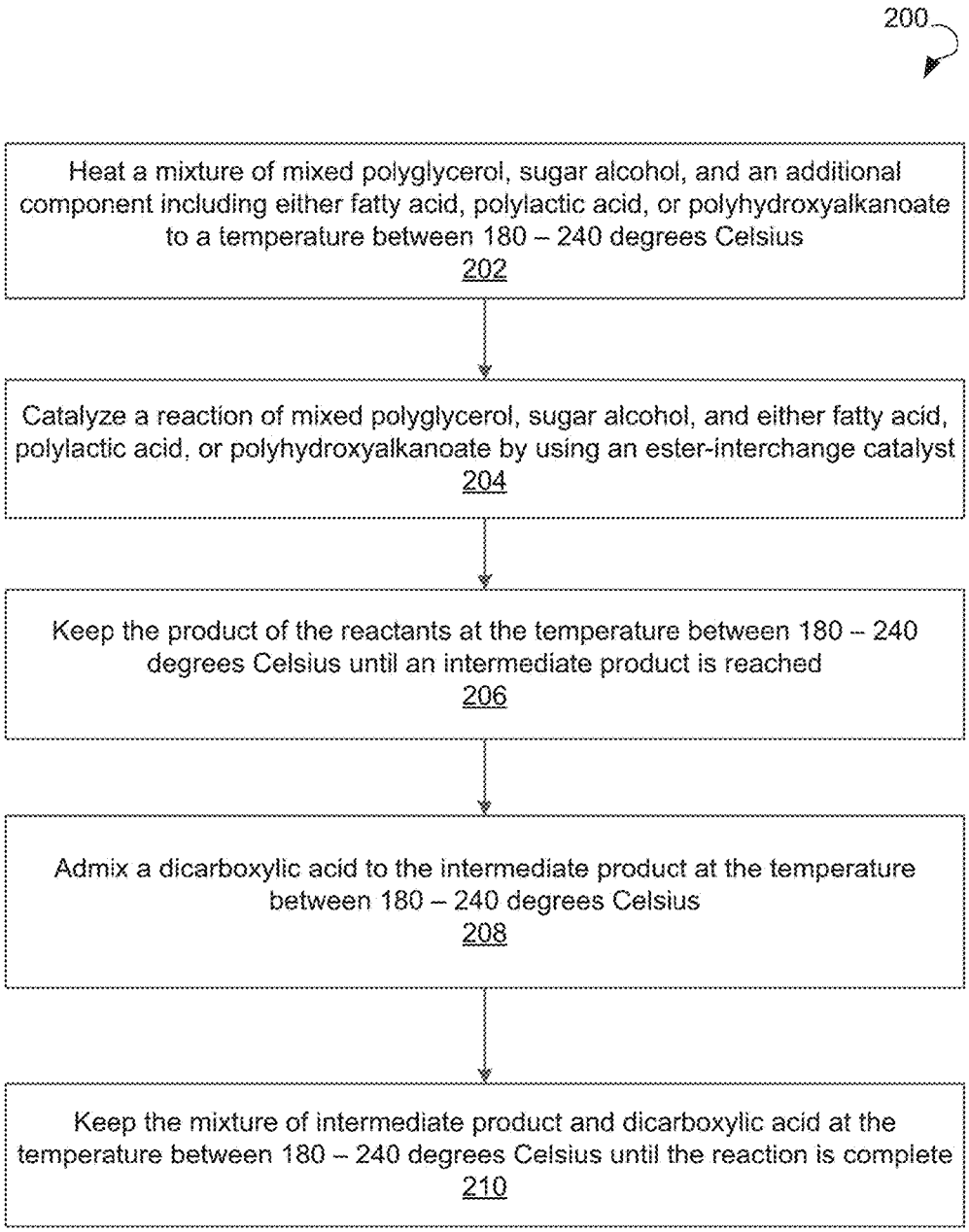
FIG. 2 is a flow chart of a method for synthesizing a water-soluble polyester to be used for preventing of dye redeposition, according to some example embodiments.

FIG. 2 is a flow chart showing an example method 200 for synthesizing of the water-soluble polyesters to be used for preventing dye redeposition, according to some example embodiments. The method 200 may commence in block 202 with heating a mixture comprising mixed polyglycerol, sugar alcohol, and an additional component including either fatty acid, polylactic acid, or polyhydroxyalkanoate to a temperature between 180-240 degrees Celsius.

In block 204, the method 200 may include catalyzing the reaction of mixed polyglycerol, sugar alcohol, and either fatty acid, polylactic acid, or polyhydroxyalkanoate by using an ester-interchange catalyst.

In block 206, the method 200 may include holding a product of the reactants at the temperature between 180-240 degrees Celsius until an intermediate product is reached. The intermediate product can be characterized by no visual separation or layering in the product.

In block 208, the method 200 may include admixing a dicarboxylic acid to the intermediate product at the temperature between 180-240 degrees Celsius.

In block 210, the method 200 may include holding the mixture of the intermediate product and dicarboxylic acid at the temperature between 180-240 degrees Celsius until the reaction is complete.

Figure 3:
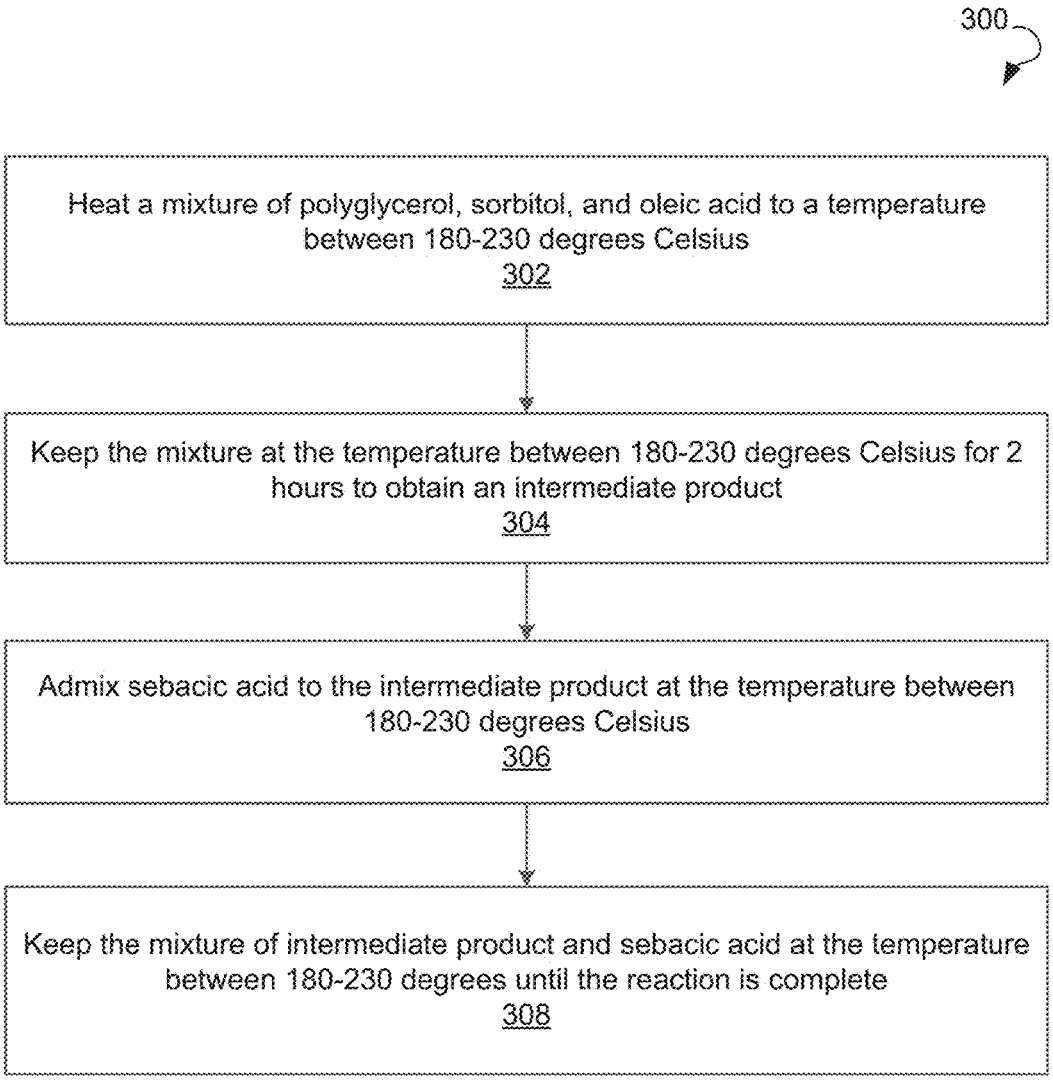
FIG. 3 is a flow chart of a method for synthesizing a water-soluble polyester to be used for preventing of dye redeposition, according to an example embodiment.

FIG. 3 is a flow chart showing a method 300 for synthesizing of the water-soluble polyester to be used for preventing dye redeposition, according to an example embodiment. The method 300 may commence, in block 302, with heating a mixture of mixed polyglycerol, sorbitol, and oleic acid to a temperature between 180-230 degrees Celsius. In block 304, the method 300 may include holding the mixture at the temperature between 180-230 degrees Celsius for 2 hours to obtain an intermediate product. In block 306, the method 300 may include adding sebacic acid to the intermediate product at the temperature between 180-230 degrees Celsius. In block 308, the method 300 may include holding a mixture of the intermediate product and sebacic acid until the reaction is complete.

Figure 4:
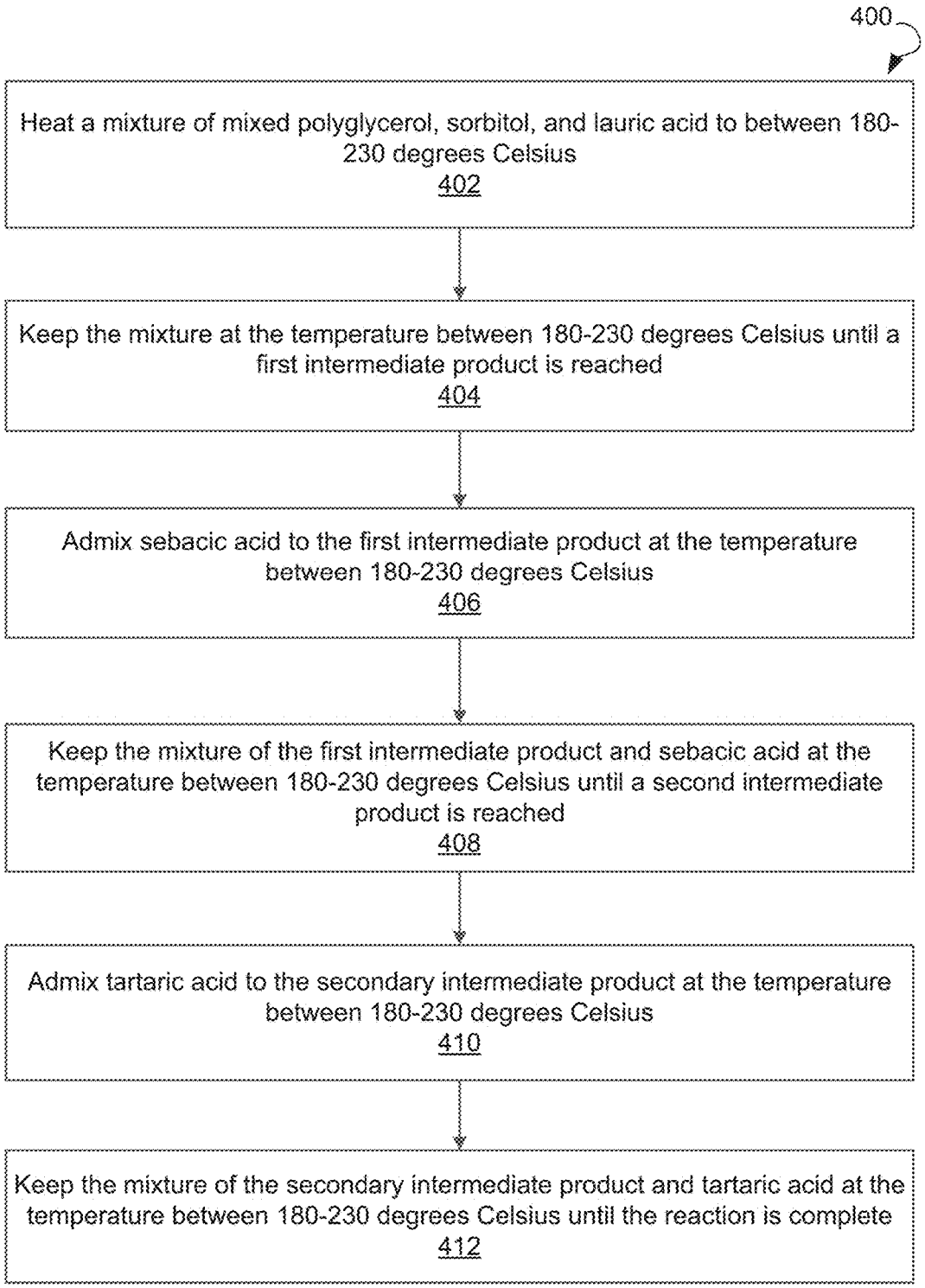
FIG. 4 is a flow chart of a method for synthesizing a water-soluble polyester to be used for preventing of dye redeposition, according to another example embodiment.

FIG. 4 is a flow chart showing a method 400 for synthesizing of the water-soluble polyester to be used for preventing dye redeposition, according to a preferred embodiment. The method 400 may commence, in block 402, with heating mixture of mixed polyglycerol, sorbitol, and lauric acid to a temperature between 180-230 degrees Celsius.

In block 404, the method 400 may include holding the mixture at the temperature between 180-230 degrees Celsius until a first intermediate product is reached. The first intermediate product can be characterized by no visual separation or layering in the product.

In block 406, the method 400 may include adding sebacic acid to the first intermediate product at the temperature between 180-230 degrees Celsius.

In block 408, the method 400 may include holding mixture of the intermediate product and sebacic acid at the temperature between 180-230 degrees Celsius until a second intermediate product is reached. The second intermediate product can be characterized by turning the mixture from translucent to opaque.

In block 410, the method 400 may include adding tartaric acid to the second intermediate product at the temperature between 180-230 degrees Celsius.

In block 412, the method 400 may include holding the mixture of the secondary intermediate product and tartaric acid at the temperature between 180-230 degrees Celsius until the reaction is complete.

Thus, methods for preventing dye redeposition onto dyed fabric are disclosed. While the present embodiments have been described in connection with a series of embodiments, these descriptions are not intended to limit the scope of the subject matter to the particular forms set forth herein. It will be further understood that the methods are not necessarily limited to the discrete components described. To the contrary, the present descriptions are intended to cover such alternatives, modifications, and equivalents as may be included within the spirit and scope of the subject matter as disclosed herein and defined by the appended claims and otherwise appreciated by one of ordinary skill in the art.

What is claimed is:

1. A method for preventing a dye redeposition onto a dyed fabric during washing, the method comprising:

determining a weight of the dyed fabric; and adding an anti-redeposition agent to an aqueous bath, wherein:

a weight of the anti-redeposition agent is 0.1% to 1% of the weight of the dyed fabric; and the anti-redeposition agent includes a water-soluble polyester made from bio-renewable raw materials, the water-soluble polyester comprising a reaction product of at least of:

a polyglycerol mixture;

a sugar alcohol;

a sebacic acid; and one of an unsaturated fatty acid, a saturated fatty acid, a fat or an oil, a polylactic acid, or polyhydroxyalkanoate.

2. The method of claim 1, wherein the dyed fabric is made from one or more of natural fibers and synthetic fibers.

3. The method of claim 1, wherein the polyglycerol mixture comprises mono-glycerol, di-glycerol, tri-glycerol, and tetra-glycerol.

4. The method of claim 1, wherein the sugar alcohol includes erythritol, threitol, arabitol, xylitol, ribitol, mannitol, sorbitol, galactitol, fucitol, or a mixture thereof.

5. The method of claim 1, wherein the water-soluble polyester is a reaction product of:

from 30% to 70% by weight of the polyglycerol mixture;

from 0% to 20% by weight of the sugar alcohol;

from 0% to 30% by weight of the unsaturated fatty acid; and from 15% to 25% by weight of the sebacic acid.

6. The method of claim 5 wherein the unsaturated fatty acid includes a myristoleic acid, a palmitoleic acid, a sapienic acid, an oleic acid, an elaidic acid, a vaccenic acid, a linoleic acid, a linoelaidic acid, an α-linolenic acid, or a mixture thereof.

7. The method of claim 1, wherein the saturated fatty acid includes caprylic acid, capric acid, lauric acid, myristic acid, palmitic acid, stearic acid, or a mixture thereof.

8. The method of claim 1, wherein the water-soluble polyester is a reaction product of:

from 10% to 40% by weight of the polyglycerol mixture;

from 10% to 20% by weight of the sugar alcohol;

from 15% to 30% by weight of one of the fat or the oil; and from 15% to 25% by weight of the sebacic acid.

9. The method of claim 8, wherein:

the fat includes a tallow derived from poultry or beef; and the oil includes coconut oil, palm oil, cottonseed oil, soybean oil, olive oil, corn oil, canola oil, sunflower oil, or a mixture thereof.

10. The method of claim 1, wherein the water-soluble polyester is a reaction product of:

from 10% to 40% by weight of the polyglycerol mixture;

from 10% to 20% by weight of the sugar alcohol;

from 15% to 30% by weight of the polylactic acid; and from 1% to 15% by weight the sebacic acid.

11. The method of claim 1, wherein the water-soluble polyester is a reaction product of:

from 10% to 40% by weight of the polyglycerol mixture;

from 10% to 20% by weight of the sugar alcohol;

from 15% to 30% by weight of the polyhydroxyalkanoate; and from 1% to 15% by weight of the sebacic acid.

12. The method of claim 1, further comprising adding the water-soluble polyester as a protecting agent for stretch fabrics during industrial washing.

13. The method of claim 1, further comprising adding the water-soluble polyester as a sequestering agent and a soil-release agent to a laundry detergent during garment washing.

14. An anti-redeposition agent for preventing a dye redeposition onto dyed fabric during washing, the anti-redeposition agent comprising a water-soluble polyester made from bio-renewable raw materials, the water-soluble polyester being a reaction product of:

a polyglycerol mixture comprising of mono-glycerol, di-glycerol, tri-glycerol, and tetra-glycerol;

a sugar alcohol;

a sebacic acid; and one of an unsaturated fatty acid, a saturated fatty acid, a fat or an oil, a polylactic acid, or polyhydroxyalkanoate.

15. The anti-redeposition agent of claim 14, wherein the sugar alcohol includes erythritol, threitol, arabitol, xylitol, ribitol, mannitol, sorbitol, galactitol, fucitol, or a mixture thereof.

16. The anti-redeposition agent of claim 14, wherein the water-soluble polyester is a reaction product of:

from 30% to 70% by weight of the polyglycerol mixture;

from 0% to 20% by weight of the sugar alcohol;

from 0% to 30% by weight of the unsaturated fatty acid, wherein the unsaturated fatty acid includes a myristoleic acid, a palmitoleic acid, a sapienic acid, an oleic acid, an elaidic acid, a vaccenic acid, a linoleic acid, a linoelaidic acid, an α-linolenic acid, or a mixture thereof; and from 15% to 25% by weight of the sebacic acid.

17. The anti-redeposition agent of claim 14, wherein the water-soluble polyester is a reaction product of:

from 10% to 40% by weight of the polyglycerol mixture;

from 10% to 20% by weight of the sugar alcohol;

from 15% to 30% by weight of one of the fat or the oil; and from 15% to 25% by weight of the sebacic acid.

18. The anti-redeposition agent of claim 17, wherein:

the fat is a tallow derived from poultry or beef; and the oil includes coconut oil, palm oil, cottonseed oil, soybean oil, olive oil, corn oil, canola oil, sunflower oil, or a mixture thereof.

* * * * *